United States Patent [19]

Foote

[11] 4,432,162

[45] Feb. 21, 1984

[54] PORTAL GUARD

[76] Inventor: Daniel J. Foote, 7323 Wellauer Dr., Wauwatosa, Wis. 53213

[21] Appl. No.: 367,397

[22] Filed: Apr. 12, 1982

[51] Int. Cl.[3] ..... E06B 9/01

[52] U.S. Cl. ..... 49/55; 160/161

[58] Field of Search ..... 49/55, 57; 160/104, 160/161

[56] References Cited

U.S. PATENT DOCUMENTS

| | | | |
|---|---|---|---|
| 2,324,743 | 7/1943 | Walker | 160/161 X |
| 2,562,428 | 7/1951 | Hutchinson | 160/161 |
| 2,698,656 | 1/1955 | Levey | 160/104 |

*Primary Examiner*—Kenneth Downey

*Attorney, Agent, or Firm*—Andrus, Sceales, Starke & Sawall

[57] ABSTRACT

A security device for preventing entry through a window includes a plurality of elongated arms pivotally connected to each other at substantially their center points so that the arms may be rotated about the pivot point and be positioned at various angles relative to each other. Each of the elongated arms is provided with a hole at each of its ends so that the arms may be mounted on the frame of a window. The elongated arms are releasably connected at their pivot point so that the number of arms may be varied as needed.

2 Claims, 3 Drawing Figures

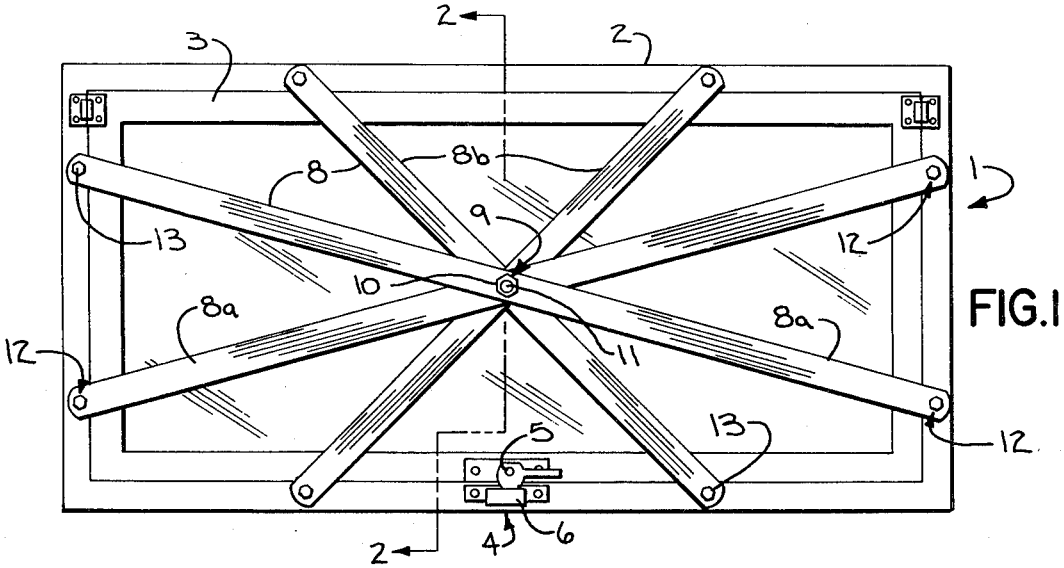
FIG.1
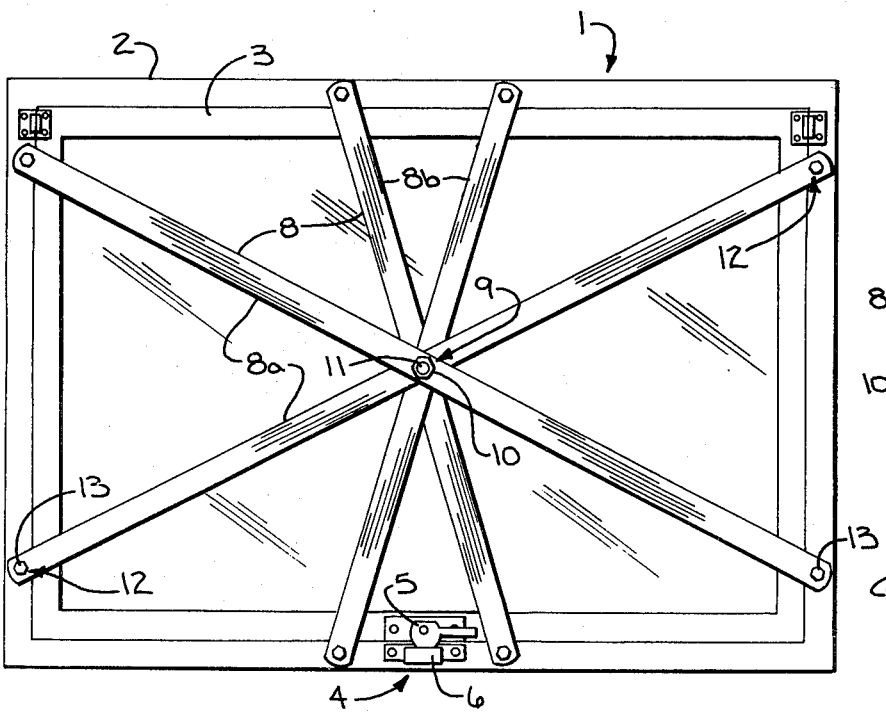
FIG.3
FIG.2
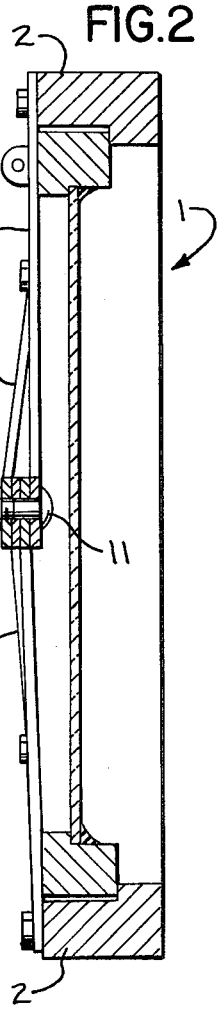

PORTAL GUARD

BACKGROUND OF THE INVENTION

Heretofore, unauthorized entry through windows, especially basement windows, has been prevented by installing iron bars across the windows or by permanently covering the windows by bricking them over or other such means.

The installation of bars across the windows is an expensive and laborious process due to the fact that it requires the drilling of holes and the preparation of seats for the ends of the bars, along with the application of an adhesive such as cement once the bars are in place.

The covering of the windows, such as with bricks, is also an expensive and laborious project and also has the undesirable effect of preventing any passage of light through the window.

It is the task of the present invention to provide a window guard that can be easily and inexpensively mounted on windows of various sizes.

It is a further task of the present invention to provide a window guard that permits the passage of light through the window after its installation.

The window guard may also be mounted on the outside of the window. Thus, allowing the window to be opened from the inside to permit the passage of air through the opening while preventing unauthorized entry through the opening.

SUMMARY OF THE INVENTION

A security device for preventing entry through a window includes a plurality of elongated arms pivotally connected to each other at substantially their center point. The pivotal connection allows the arms to be rotated about the center point and be positioned at various angles relative to each other. The arms are provided with mounting means at their ends for securing the arms to the frame of the window.

In accordance with one aspect of the invention, the security device is provided with arms of at least two different lengths so that the device may be mounted on window frames of various sizes.

In accordance with yet another aspect of the invention, the elongated arms are releasably connected at the pivot point so that the number of arms in the device may be varied.

The present invention thus provides a window guard that may be easily and inexpensively mounted on windows of various sizes.

The present invention also provides a device that prevents entry through a window and yet allows for the passage of light through the window.

BRIEF DESCRIPTION OF THE DRAWINGS

The drawings illustrate the best mode presently contemplated of carrying out the invention.

In the drawings:

FIG. 1 is a rear elevational view of a window incorporating the security device of the invention;

FIG. 2 is a sectional view taken along line 2—2 of FIG. 1;

FIG. 3 is a rear elevational view of the security device mounted on a window having a shape different from that of the window in FIG. 1.

DESCRIPTION OF THE PREFERRED EMBODIMENT

As illustrated in FIG. 1, a window 1 is of a type normally installed at the basement level and consists of an outer frame 2 which is mounted in the wall of the building and an inner frame 3 pivotally connected to the upper corners of outer frame 2 so that inner frame 3 may be pivoted inwardly and upwardly to open window 1. A latching mechanism 4 consisting of a pivotal hook 5 mounted on inner frame 3 and a bracket 6 mounted on outer frame 2 permits the window to be locked in its closed position.

A security device 7 for preventing unauthorized entry through window 1 consists of a plurality of elongated legs 8 pivotally connected at a point 9 located substantially at the center of elongated legs 8. Legs 8 are releasably connected at point 9 by means of nut 10 and bolt 11. Thus, if so desired, additional legs 8 may be added to security device 7, or if desirable, legs may be removed.

Each of elongated legs 8 is provided with a hole 12 approximate each of its ends. When mounting security device 7 to window 1, each elongated leg 8 is pivoted about point 9 until holes 12 in leg 8 overlap outer frame 2. Screws or bolts 13 are then inserted into holes 12 and embedded in outer frame 2. When security device 7 is so secured to outer frame 2, inner frame 3 may not be pivoted to an open position when latching mechanism 4 is open.

In order to accommodate windows of various sizes, security device 7 is provided with elongated legs of two different lengths, 8*a* and 8*b*. Thus, for very wide windows such as shown in FIG. 1, legs 8*a* may be pivoted close to the horizontal in order to accommodate the width of the window. While with windows of a lesser width, such as shown in FIG. 3, legs 8*a* may be pivoted further from the horizontal to accommodate the narrower frame. Likewise, as the height of the window increases or decreases, legs 8*b* may be pivoted to adjust to the different sizes.

Thus, the present invention provides a security device that may be readily installed on windows of varying sizes.

While the previous description has been limited to windows and particularly those of the size and shape for use in basements, the security device may be used in conjunction with any portal through which unauthorized entry is to be prevented e.g. windows in doors, milk chutes, etc.

Various modes for carrying out the invention are contemplated as being within the scope of the following claims particularly pointing out and distinctly claiming the subject matter which is regarded as the invention.

I claim:

1. A security device for preventing entry through a portal comprising:

a plurality of elongated arms pivotally connected to each other at a single centrally located point intermediate their ends so that said arms may be rotated independently of each other about said single pivot point and be positioned at various angles relative to each other, and said arms being of at least two different lengths so that rotation of said arms about said single pivot point allows the ends of said arms to substantially conform to all four sides of rectangular openings of various sizes and said arms having mounting means approximate their ends to secure said arms to the frame of the portal.

2. The security device of claim 1 wherein said arms are releasably joined at said pivot point so that the number of said arms in said device may be varied.

* * * * *